US007832017B2

(12) United States Patent
Nascimento et al.

(10) Patent No.: US 7,832,017 B2
(45) Date of Patent: Nov. 16, 2010

(54) LEG GUARD

(75) Inventors: Christopher J. Nascimento, Beaverton, OR (US); Herbert Ki Yoo, Beaverton, OR (US); Chris S. Page, Portland, OR (US)

(73) Assignee: Nike, Inc., Beaverton, OR (US)

( * ) Notice: Subject to any disclaimer, the term of this patent is extended or adjusted under 35 U.S.C. 154(b) by 673 days.

(21) Appl. No.: 11/669,224

(22) Filed: Jan. 31, 2007

(65) Prior Publication Data

US 2008/0178360 A1 Jul. 31, 2008

(51) Int. Cl.
*A41D 13/00* (2006.01)

(52) U.S. Cl. ..... 2/22

(58) Field of Classification Search ..... 2/455, 2/16, 22, 24, 62, 23, 911
See application file for complete search history.

(56) References Cited

U.S. PATENT DOCUMENTS

| | | | | |
|---|---|---|---|---|
| 1,624,129 | A | | 4/1927 | Barrett |
| 2,982,968 | A | | 5/1961 | Groot |
| 3,135,964 | A | | 6/1964 | Pender |
| 3,772,704 | A | * | 11/1973 | Carbonneau ..... 2/22 |
| 4,692,946 | A | | 9/1987 | Jurga |
| D297,178 | S | | 8/1988 | Jurga |
| 4,888,826 | A | | 12/1989 | Parsons, Jr. et al. |
| 4,953,913 | A | | 9/1990 | Graebe |
| 5,056,158 | A | | 10/1991 | Lutz |
| 5,147,685 | A | | 9/1992 | Hanson |
| 5,405,312 | A | | 4/1995 | Jacobs |
| 5,452,475 | A | | 9/1995 | Hunt |
| 5,477,559 | A | | 12/1995 | Clement |
| 5,592,706 | A | | 1/1997 | Pearce |
| 5,594,954 | A | | 1/1997 | Huang |
| 5,634,214 | A | | 6/1997 | St. Ville |
| 5,652,956 | A | | 8/1997 | Hoshizaki et al. |
| 5,662,594 | A | | 9/1997 | Rosenblatt |
| 5,732,411 | A | | 3/1998 | Coleman et al. |

(Continued)

FOREIGN PATENT DOCUMENTS

| | | |
|---|---|---|
| JP | 2002045458 | 2/2002 |

(Continued)

OTHER PUBLICATIONS

Prosecution History from U.S. Appl. No. 11/669,231, filed Jan. 31, 2007.

(Continued)

*Primary Examiner*—Tejash Patel
(74) *Attorney, Agent, or Firm*—Plumsea Law Group, LLC

(57) ABSTRACT

A leg guard for a baseball catcher includes asymmetrical knee and shin portions. The knee and shin portions include a rigid plate attached to pad. The knee portion has medial extensions of both the plate and pad to provide additional protection to the medial side of the knee when the catcher is in the crouch position. Similarly, the rigid plate of the shin portion also has a generally rectangular shape, with the medial side longer than the lateral side for additional protection of the medial side of the leg. The knee portion is generally curved. This shape stabilizes and protects the knee in transitioning from the crouch position to the blocking position and from the blocking position back to the crouch position or to an upright throwing stance.

21 Claims, 8 Drawing Sheets

U.S. PATENT DOCUMENTS

| | | | | |
|---|---|---|---|---|
| 5,794,261 | A | 8/1998 | Hefling | |
| 5,829,055 | A | 11/1998 | Collins et al. | |
| 5,840,397 | A | 11/1998 | Landi et al. | |
| 5,966,739 | A | 10/1999 | Wagner | |
| 6,065,152 | A * | 5/2000 | Parker | 2/22 |
| 6,101,629 | A * | 8/2000 | Colling | 2/24 |
| 6,122,768 | A | 9/2000 | McCrane | |
| 6,128,779 | A | 10/2000 | Goldsmith et al. | |
| 6,178,556 | B1 | 1/2001 | Foreman et al. | |
| D445,221 | S | 7/2001 | Foreman et al. | |
| 6,253,376 | B1 | 7/2001 | Ritter | |
| 6,272,682 | B1 | 8/2001 | Fullum | |
| 6,317,888 | B1 | 11/2001 | McFarlane | |
| 6,336,200 | B1 | 1/2002 | Wolfgang | |
| D461,936 | S | 8/2002 | Fiorini et al. | |
| 6,427,239 | B1 | 8/2002 | Worden | |
| 6,553,572 | B2 | 4/2003 | Fiorini et al. | |
| 6,560,781 | B1 | 5/2003 | Keene et al. | |
| 6,654,961 | B2 | 12/2003 | Beland | |
| 6,789,264 | B2 | 9/2004 | Budda | |
| 6,804,832 | B2 | 10/2004 | Beland | |
| 6,912,729 | B2 | 7/2005 | Nishimoto | |
| 7,013,487 | B2 | 3/2006 | Beland | |
| D518,922 | S | 4/2006 | Beland | |
| 7,047,566 | B2 | 5/2006 | Beland et al. | |
| D554,806 | S | 11/2007 | LeCarpentier | |
| 7,512,996 | B2 | 4/2009 | Yoo et al. | |
| 2003/0019006 | A1 | 1/2003 | Godshaw et al. | |
| 2005/0120455 | A1 | 6/2005 | Cunningham | |
| 2005/0120456 | A1 | 6/2005 | Cunningham | |
| 2005/0246812 | A1 | 11/2005 | Bevier | |
| 2005/0252119 | A1 | 11/2005 | Funk-Danielson | |
| 2006/0041985 | A1 | 3/2006 | Godshaw | |
| 2006/0041986 | A1 | 3/2006 | Godshaw | |
| 2007/0124843 | A1 | 6/2007 | Bevier | |

FOREIGN PATENT DOCUMENTS

| | | |
|---|---|---|
| JP | 2002239056 | 8/2002 |
| JP | 2003180905 | 7/2003 |
| JP | 2004190175 | 7/2004 |

OTHER PUBLICATIONS

Office Action mailed May 15, 2008 from U.S. Appl. No. 11/669,231.
Amendment filed Aug. 15, 2008 in U.S. Appl. No. 11/669,231.
Notice of Allowance mailed on Nov. 24, 2008 in U.S. Appl. No. 11/699,231.
Rule 312 Amendment filed on Dec. 8, 2008 in U.S. Appl. No. 11/699,231.

* cited by examiner

LEG GUARD

BACKGROUND OF THE INVENTION

1. Field of the Invention

The present invention relates generally to sporting equipment. More particularly, the present invention relates to a leg guard for a baseball or a softball catcher.

2. Description of Related Art

In baseball and softball, the catcher, positioned behind home plate with a view of the entire playing field, performs many vital functions during a game, from calling plays and protecting the plate to receiving the ball from the pitcher. As home plate crashes with other players and impacts from pitches in excess of 90 mph are common in baseball, the bodies of catchers are physically punished regularly during a game.

Due in part to the awkward crouching position catchers assume behind home plate, catchers commonly injure their knees. Further, the catcher's crouch entails exposing the inner legs to impacts from pitches, with the medial side of the knee often being struck by the ball. Also, a catcher's blocking motions for stopping wild, tipped, or dropped pitches requires that the catcher first drop rapidly onto their knees from the crouch, and just as rapidly either reassume the crouch or stand upright to throw out any potential base stealers. Collisions at home plate from opposing team players trying to score are common, with many slides resulting in impacts to the catcher's lower legs and knees.

Since the early days of baseball, catchers have been provided with equipment to protect their bodies from these various stresses. Typical catcher's gear includes a helmet with a face mask to protect the head and face, a chest pad to protect the torso, a thick glove to protect the hand, and leg guards to protect the legs and feet. As the knees are particularly vulnerable, various design for leg guards have been produced to allow the catcher maximum freedom of movement while still providing protection against impacts from balls or players. As a result, most leg guards employ a series of rigid padded plates which are strapped onto the leg. The use of the two materials, rigid plastic and soft, flexible padding, presents a trade-off between impact protection and freedom of movement. Unfortunately, to maintain freedom of movement of the knee, in conventional leg guards, neither the rigid plate nor the padded layer extend to cover the medial side of the leg, leaving much of the inner knee and thigh exposed to impact when the catcher is couching behind home plate.

Balancing the need for protection with the need to retain freedom of movement has led to changes in leg guard design. For example, U.S. Pat. No. 6,065,152 to Parker describes a shin guard having three panels, a front panel, a lateral side panel, and a medial side panel. Each panel includes a rigid plate backed by a cushioning material. A portion of the medial side material has been removed to allow the calf muscle to more freely expand and contract while running and cutting across the field. However, this shin guard is intended to be used by soccer players, so such a shin guard would not provide medial-side leg protection for a baseball catcher in a crouch position.

U.S. patent publication number 2003/0019006 to Godshaw et al. describes a knee pad which includes a rigid outer shell and an insert fitted inside the shell to protect and cushion a user's knee, such as while kneeling to install flooring. The insert is either asymmetric or strategically placed in the shell so as to accommodate either the left or right knee of the wearer. This construction is designed to provide maximum support and cushioning to the oppositely-shaped left and right knees. However, the shell of this construction is symmetrical, and no additional protection is provided for the medial-side of the leg.

Therefore, there exists a need in the art for a leg guard for a baseball or softball catcher which protects the catcher's leg, particularly a medial side portion of the knee, inner thigh and calf, while supporting the knee and allowing a catcher to freely maneuver from the couching to the blocking position or standing position.

SUMMARY OF THE INVENTION

In one aspect, the invention provides a leg guard comprising a knee portion having a first rigid layer and a first flexible layer connected to the first rigid layer and a shin portion having a second rigid layer and a second flexible layer connected to the second rigid layer. The first flexible layer is connected to the second flexible layer. The first rigid layer has an irregular shape, with a first rigid layer medial side extending further from a center line of the leg guard than a first rigid layer lateral side. The second rigid layer having an irregular shape, with a second rigid layer medial side extending further from the center line than a second rigid layer lateral side. A securing system is configured to removably attach the leg guard to a leg.

In another aspect, the first flexible layer has an irregular shape, with a first flexible layer medial side extending further from the center line than a first flexible layer lateral side.

In another aspect, the first flexible layer medial side is dimensioned to substantially cover a medial knee portion.

In another aspect, a third flexible layer is attached to the first flexible layer and the second flexible layer, the third flexible layer having a bulbous knee section and an elongated shin section.

In another aspect, the elongated shin section has at least one tail section.

In another aspect, a fourth flexible layer is attached to the third flexible layer, wherein an inner perimeter of a knee portion of the fourth flexible layer is configured to at least partially surround a knee cap portion of a knee.

In another aspect, at least one rigid layer comprises a plastic material.

In another aspect, at least one flexible layer comprises a foam material.

In another aspect, at least one thigh portion comprises a thigh rigid layer and a thigh flexible layer, the thigh flexible layer being connected to the first flexible layer.

In another aspect, at least one foot portion comprises a foot rigid layer and a foot flexible layer attached to the foot rigid layer, the foot flexible layer being connected to the second flexible layer.

In another aspect, the strapping system comprises at least one strap having a fixed end and a free end, the fixed end being fixedly attached to a first side of the leg guard and the free end configured to be removably attached to a second side of the leg guard.

In another aspect, a securing mechanism is attached to the free end of the strap and a receiving mechanism configured to detachably receive the securing mechanism fixedly attached to the second side of the leg guard.

In another aspect, a guide is formed in the leg guard to receive the strap to prevent the strap from shifting during wear.

In another aspect, the first rigid layer has a first radius of curvature and the second rigid layer having a second radius of curvature.

In another aspect, the first radius of curvature is different from the second radius of curvature.

In another aspect, the invention provides a protective covering for a knee comprising a rigid layer having a curved surface and a flexible layer positioned between the rigid layer and the knee. The rigid layer has an irregular shape, with a rigid layer medial side extending further from a center line of the protective covering than a rigid layer lateral side. The flexible layer has an irregular shape, with a medial-side extension to cover a portion of a medial side of the knee.

In another aspect, the medial-side extension substantially covers the medial side of the knee.

In another aspect, a strap has a fixed end and a free end. The fixed end is fixedly attached to a first side of the protective covering, and the free end is configured to be detachably connected to a second side of the protective covering.

In another aspect, the flexible layer includes flex ridges.

In another aspect, the flexible layer is attached to at least one additional flexible layer.

In another aspect, the at least one additional flexible layer is attached to a second protective covering.

In another aspect, the invention provides a protective covering for a shin comprising a rigid layer configured to cover an obverse side of the shin, the rigid layer having an irregular shape. A medial side of the rigid layer is longer than a lateral side of the rigid layer. A medial portion of the rigid layer extends further from a center line of the protective covering than a lateral portion of the rigid layer. A flexible layer is positioned between the rigid layer and the shin, and a strapping system is configured to removably attach the rigid layer and the flexible layer to a leg.

In another aspect, the flexible layer covers a greater area than the rigid layer.

In another aspect, the flexible layer includes a split portion.

In another aspect, the flexible layer is attached to at least one additional flexible layer.

In another aspect, the at least one additional flexible layer is attached to a second protective covering.

In another aspect, the at least one additional flexible layer has a dentoid shape.

Other systems, methods, features and advantages of the invention will be, or will become, apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION OF THE PREFERRED EMBODIMENTS

To receive a ball from a pitcher during a baseball or softball game, the catcher generally crouches behind home plate. As the ball is generally thrown by professionals at speeds exceeding 90 mph, a catcher wears protective equipment to protect the catcher from impacts by the ball. The protective equipment also protects the catcher from collisions with other players, such as base runners attempting to score at home plate.

Figure 1:
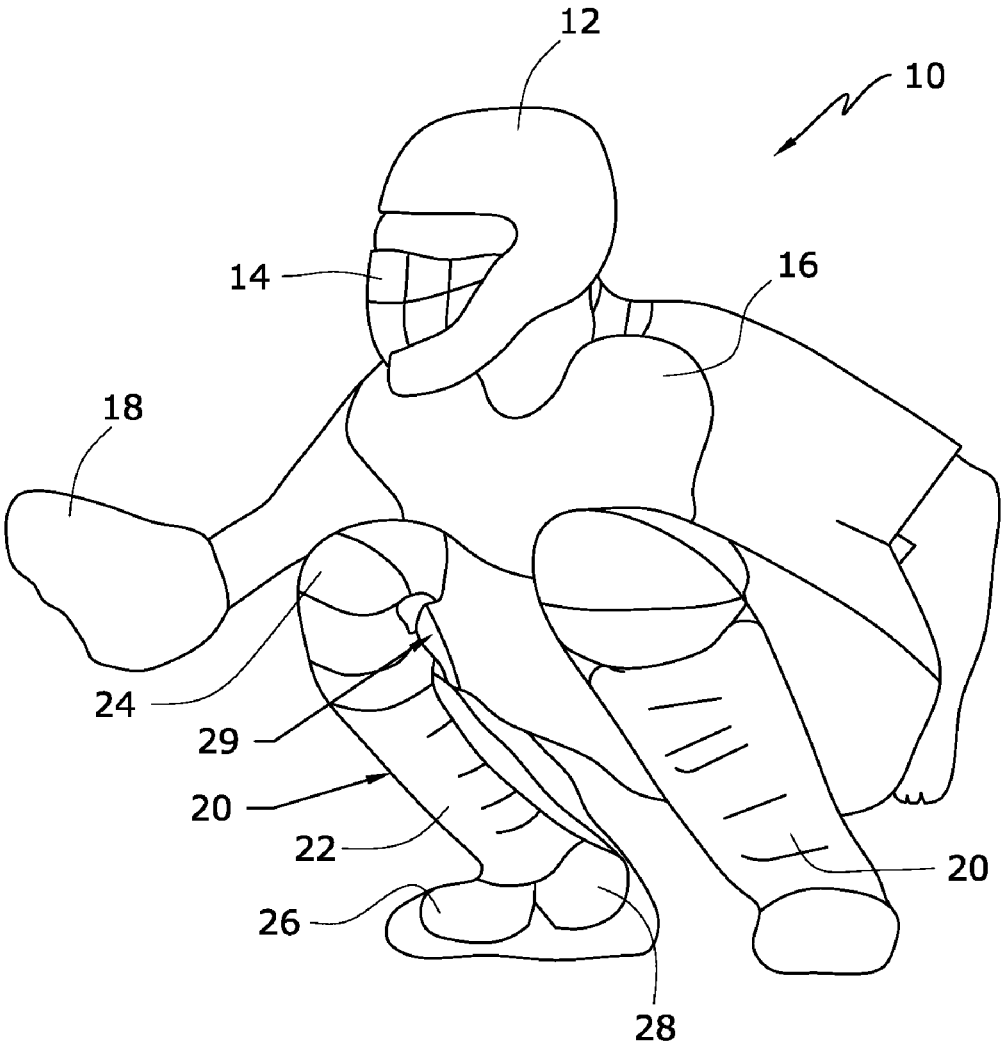
FIG. 1 (Prior Art)
FIG. 1 is a schematic drawing of a baseball catcher wearing a prior art leg guard.

FIG. 1 is a schematic view of a catcher 10 wearing conventional protective equipment in a typical crouch position. The equipment includes a helmet 12 with a face mask 14 to protect the head and face of catcher 10, a chest pad 16 to protect the torso, a glove to protect the hand, and leg guards 20 to protect the shins, feet, and knees. Leg guards 20 include generally a shin portion 22 hingedly attached at a lower end to an ankle or instep portion 28 and/or a foot portion 26. Additionally, shin portion 22 is hingedly attached to a knee portion 24. Knee portion 24 covers the knee cap but does not extend to cover and protect a medial knee portion 29. Knee portion 24, shin portion 22, instep portion 28, and foot portion 26 typically include a rigid outer layer and a pad layer.

Many defensive moves made by the catcher originate from this stance. Such defensive moves include blocking wild pitches, in which case the catcher drops from the crouch position to the knees, with the inner portion of the knees impacting the ground as the legs are brought together to block the ball. Another defensive move entails moving from the crouch to a standing position to throw out a base runner attempting to steal a base. The hinged attachment of shin portion 22 to knee portion 24 allows catcher 10 to bend and extend the leg.

Figure 2:
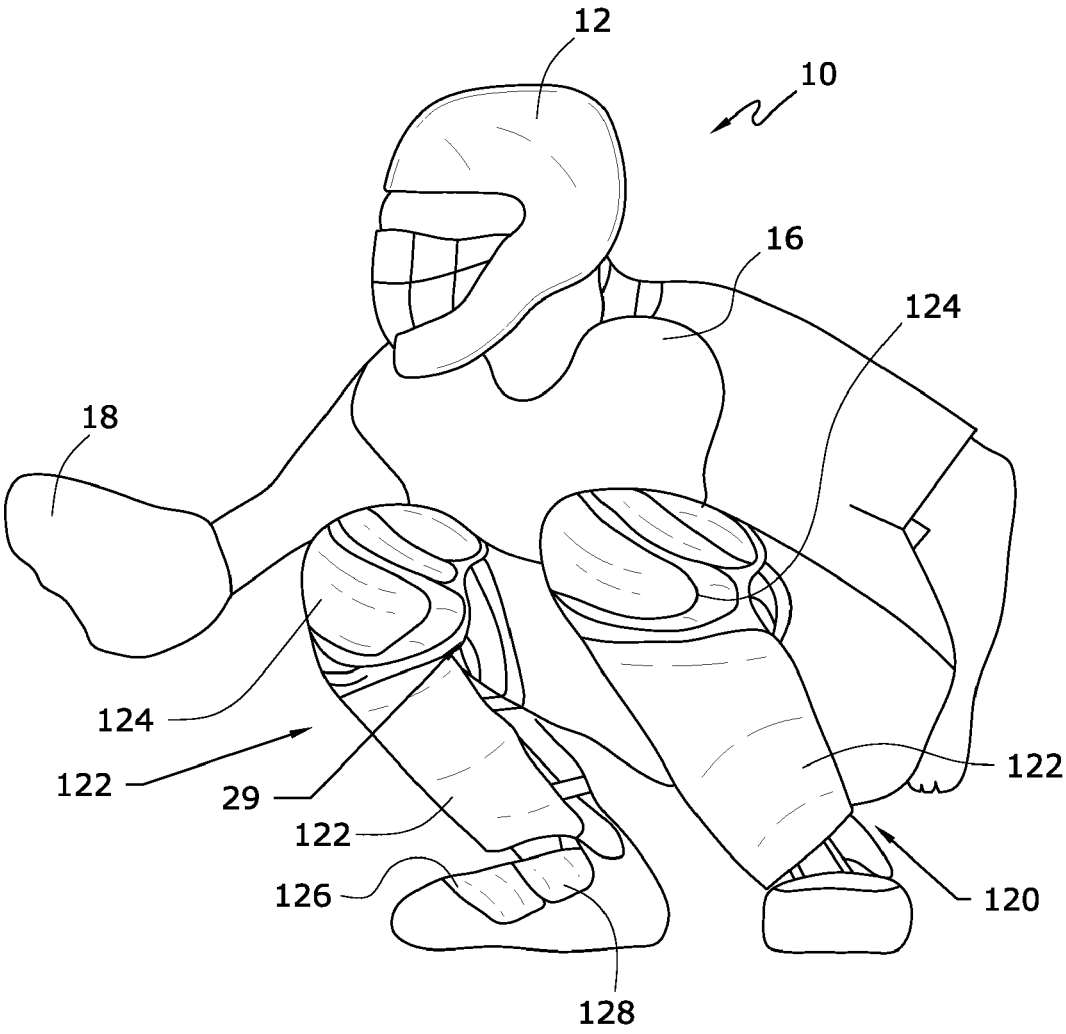
FIG. 2 is a schematic drawing of a baseball catcher wearing a leg guard according to the invention.

FIG. 2 shows catcher 10 wearing similar equipment as shown in FIG. 1, but with leg guards 120 according to the invention. Leg guards 120 also include a shin portion 122 hingedly attached at a lower end to an instep portion 128 and a foot portion 126. Also, shin portion 122 is hingedly attached at the opposite end to a knee portion 124. However, unlike in the conventional leg guard 20 shown in FIG. 1, knee portion 124 covers not only the kneecap portion of the leg of catcher 10, but also extends to cover a significant portion of medial knee portion 29. This configuration provides additional protection against impact from pitches while catcher 10 remains in the crouch position.

To provide this additional protection without decreasing or significantly decreasing the range of motion of the leg of catcher 10, as shown in FIGS. 4-7, leg guard 120 includes irregularly-shaped knee portion 124 and shin portion 122. Preferably, the irregular or uneven shape of knee portion 124 and shin portion 122 cause knee portion 124 and shin portion 122 to have asymmetric shapes around a center line C. Center line C is any vertical reference line which passes through a geometric center point of the knee and is perpendicular to a floor or other substantially flat ground surface, especially when catcher 10 is standing in an upright stance. While only one leg guard 120 is shown, that for a right leg, leg guard 120 is preferably provided in pairs, with the left leg guard a mirror image of the right leg guard shown in the figures.

In a preferred embodiment, as shown in FIGS. 4-7, the hingedly attached portions of leg guard 120 include a first thigh portion 140 connected to a second thigh portion 141. Second thigh portion 141 is hingedly attached to knee portion 124, which is hingedly attached to shin portion 122. Shin portion 122 is hingedly attached to ankle portion 128, which is also hingedly attached to foot portion 126. In other embodiments, two or more of these hingedly attached portions may be provided as single units. For example, first and second thigh portions 140, 141 may be included in leg guard 120 as a single thigh portion. Similarly, one or more of these hingedly attached portions may be eliminated, such as providing only second thigh portion 141 while excluding first thigh portion 140.

Each of these hingedly attached portions preferably includes a rigid outer shell connected to a padded layer. This configuration is selected to provide the most comfortable protection against impacts and collisions, as the outer shell provides unyielding resistance to hard collisions, such as an impact from a stray pitch, while dissipating that impact force through the pad layer. Further, the pad layer is preferably positioned between the leg and the rigid layer, which provides a more comfortable fit for the wearer. For example, first thigh portion 140 includes a first thigh plate 142 attached to a first thigh pad 143; second thigh portion 141 includes a second thigh plate 144 attached to second thigh pad 145; knee portion 124 includes a knee plate 136 attached to knee pad 137; shin portion 122 includes a shin plate 138 attached to shin pad 139; ankle portion 128 includes an ankle plate 150 attached to ankle pad 151; and foot portion 126 includes a foot plate 148 attached to foot pad 149. Each of these plates 136, 138, 142, 144, 148, 150 is preferably made from a rigid, durable material, such as plastic or a composite material like fiberglass or carbon reinforced epoxy. Plates 136, 138, 142, 144, 148, 150 are preferably manufactured by injection molding, though plates 136, 138, 142, 144, 148, 150 may, in other embodiments, be made by any other type of manufacturing technique known in the art.

Plates 136, 138, 142, 144, 148, 150 are preferably attached, respectively, to pads 137, 139, 143, 145, 149, 151. Pads 137, 139, 143, 145, 149, 151 are preferably cushioning panels made of any material known in the art, such as foam, natural or synthetic batting, or similar materials. Additionally, combinations of materials may be used, such as providing a foam or memory foam wrapped or covered in a wicking material for additional comfort while wearing leg guards 120 for long periods of time in hot weather. Pads 137, 139, 143, 145, 149, 151 may be fixedly or removably attached to plates 136, 138, 142, 144, 148, 150. For example, pads 137, 139, 143, 145, 149, 151 may be attached to plates 136, 138, 142, 144, 148, 150 removably, such as with hook-and-loop closures such as Velcro®, snaps, clips, or the like. Preferably, however, pads 137, 139, 143, 145, 149, 151 are fixedly attached to plates 136, 138, 142, 144, 148, 150 by any method known in the art, such as with an adhesive, rivets, stitches or the like.

Each portion 122, 124, 126, 128, 140, 142 preferably has a unique size and shape so that each portion 122, 124, 126, 128, 140, 142 is best fitted to the part of the leg that portion is intended to cover. For example, foot portion 126 is preferably smaller than first thigh portion 140. Similarly, each plate 136, 138, 142, 144, 148, 150 is preferably curved to best match the curvature of the leg, with first thigh plate 140 having a reduced radius of curvature compared with foot portion 126, as the diameter of the foot is typically less than the diameter of the thigh.

The shape of knee portion 124 is preferably asymmetric around center line C, with medial side 121 of knee portion 124 extending further from center line C than lateral side 123 of knee portion 124. Preferably, both knee plate 136 and knee pad 137 have this asymmetric configuration, although in other embodiments, only one of knee plate 136 and knee pad 137 have a medial side which extends further from center line C than the lateral side.

Figure 3:
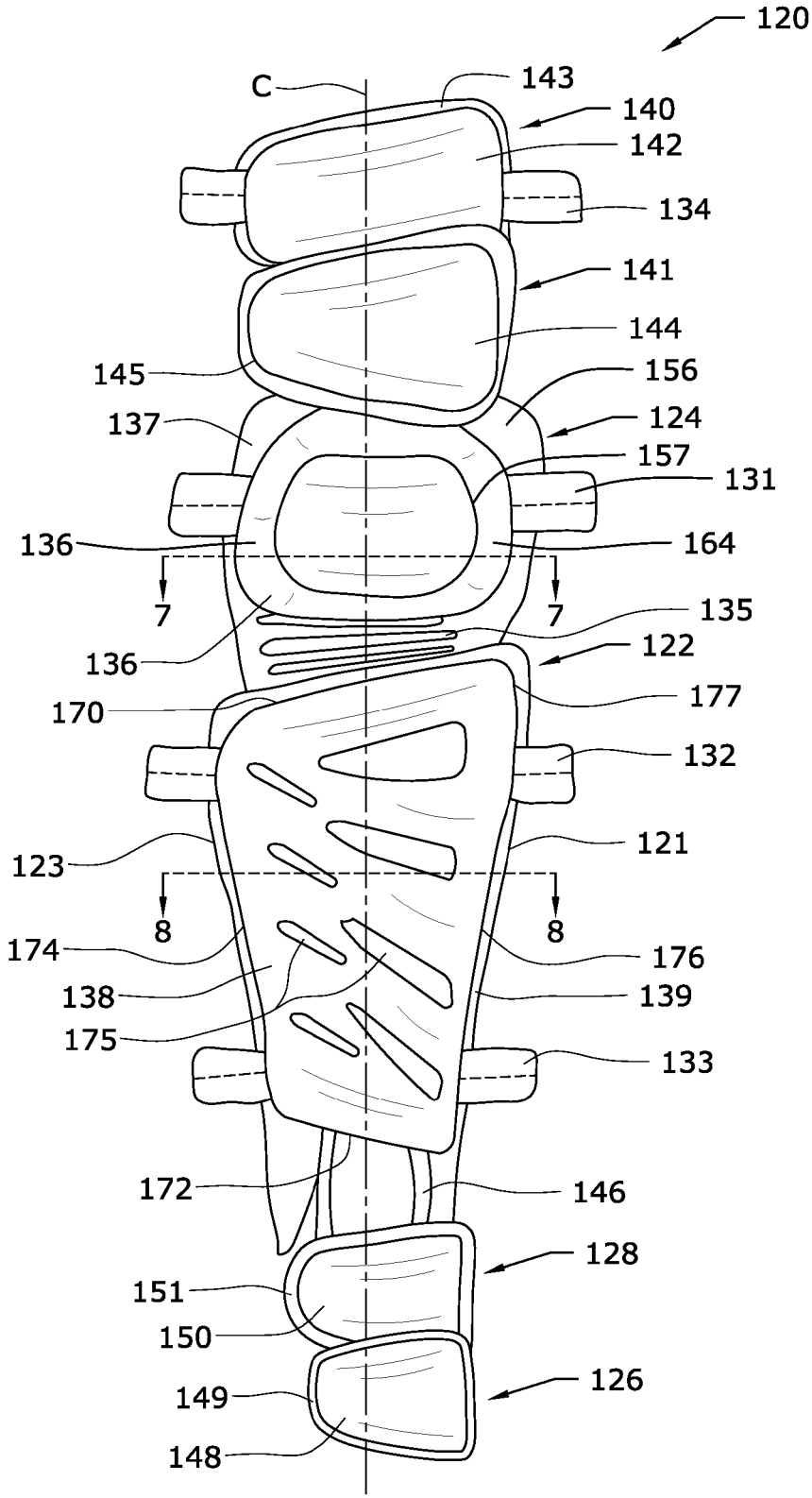
FIG. 3 is a schematic front view of a preferred embodiment of a leg guard according to the invention.
Figure 7:
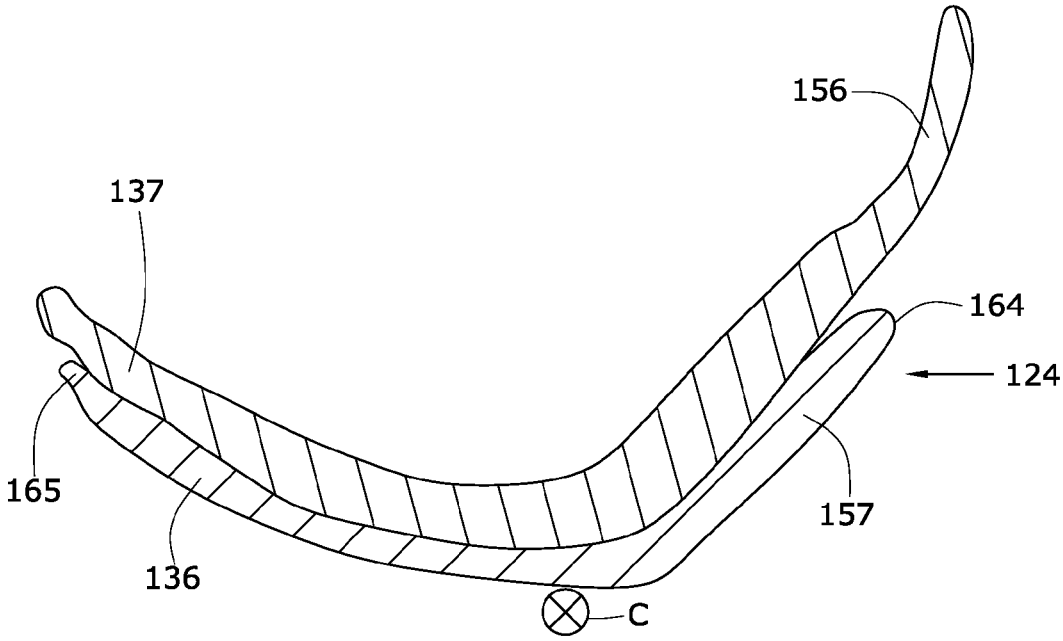
FIG. 7 is a cross-sectional view of a knee portion of the leg guard of FIG. 3, taken along line 7-7 in FIG. 3.

As shown in FIGS. 3 and 7, knee plate 136 is preferably a cup-shaped component so as best to provide capacity for the knee cap section of the leg when catcher 10 is in the crouch position. Knee plate medial side 164 extends further from center line C than knee plate lateral side 165, so that a knee plate medial extension 157 wraps around the knee to cover medial knee portion 29 (as shown in FIG. 2.) Preferably, knee plate medial side 164 has a smaller height than knee plate lateral side 165. This smaller height of knee plate medial side 164 accommodates the bending of the knee, so that the rigid material of knee plate 136 does not stop the thigh from pressing against the calf of the leg.

As shown in FIGS. 3 and 7, preferably knee pad 137 also includes a medial extension 156 which extends further from center line C than does a lateral side 123 of knee pad 137. Medial extension 156 covers at least a portion of the exposed inner knee and thigh of catcher 10. For example, in one embodiment sized for an average adult, medial extension 156 may extend approximately 6-10 inches from center line C. In another embodiment sized for a child, medial extension 156 may extend only 3-6 inches from center line C. Preferably, knee pad medial extension 156 covers a greater area of medial knee portion 129 than does knee plate medial extension 157. As with knee plate 136, lateral side 123 of knee pad 137 does not extend as far from center line C, as the lateral side of the leg of catcher 10 does not require additional protection, as the lateral side of the leg is not exposed to the pitches when catcher 10 is in the crouch position. Optionally, to enhance the flexibility of knee pad 137, knee pad 137 may include flex ridges 135. Flex ridges 135 are preferably indentations formed in knee pad 137, such as by compression molding.

The shape of knee portion 124 also protects the knee joint as catcher 10 moves from the crouch position as shown in FIG. 2 to a blocking position, where catcher 10 drops onto the knees. This motion tends to cause medial knee portion 29 to impact the ground. The medial side extensions of knee plate 136 and knee pad 137 absorb this impact, sparing the knee joint the brunt of the impact with the ground.

Figure 5:
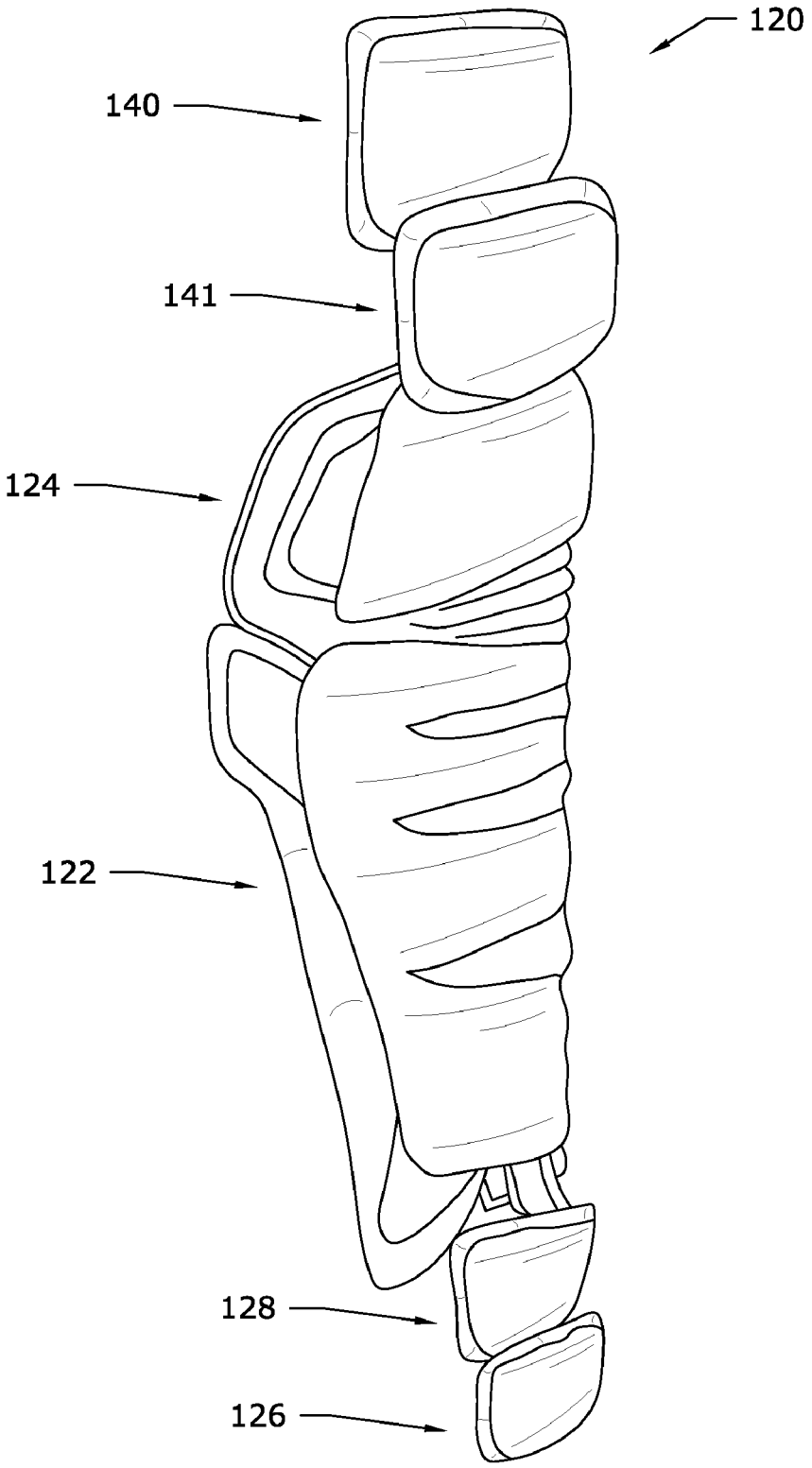
FIG. 5 is a schematic lateral side view of the leg guard of FIG. 3.
Figure 6:
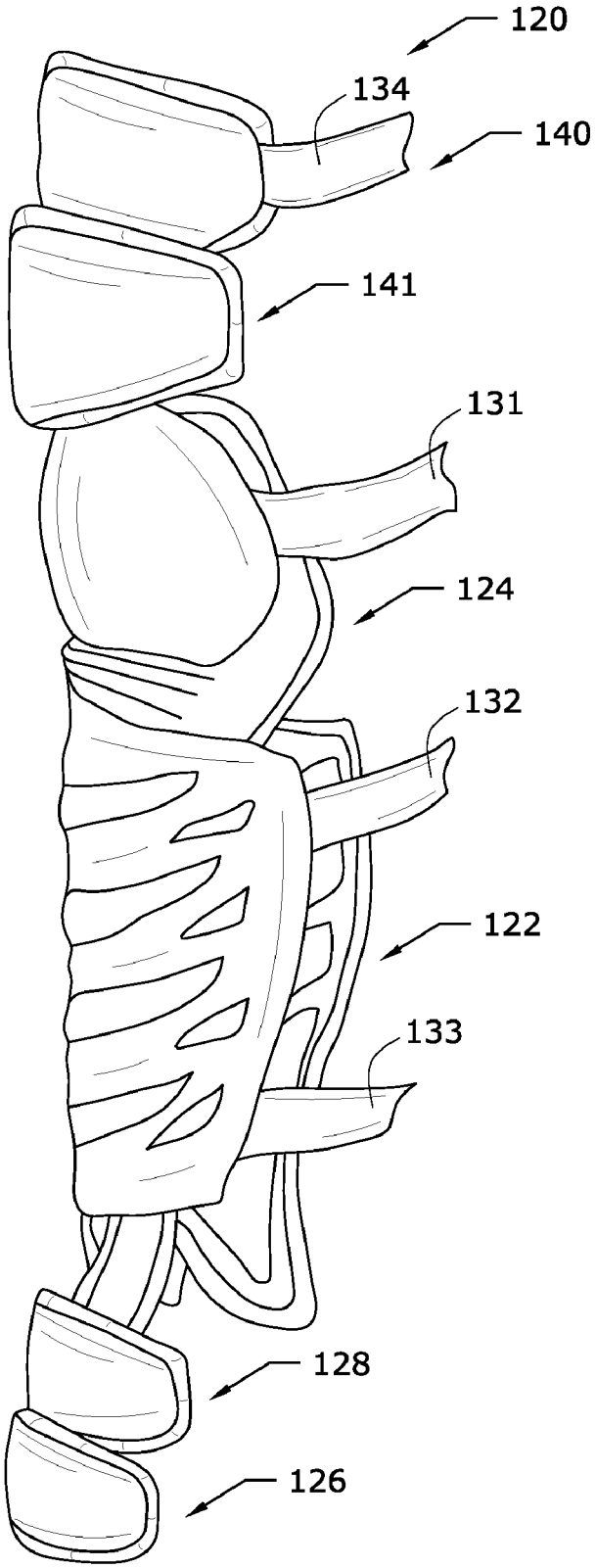
FIG. 6 is a schematic medial side view of the leg guard of FIG. 3.

Shin portion 122 is also asymmetric, preferably with both shin plate 138 and shin pad 139 including medial side 121 portions which extend further from center line C than lateral side 123 portions. Preferably, shin plate 138 is a rigid component the same as or similar to knee plate 136 in materials and manufacturing. Preferably, shin plate 138 is generally an irregular trapezoid in shape, with the short legs of the trapezoid forming an upper edge 170 (adjacent to knee portion 124) and a lower edge 172 (adjacent to ankle portion 128) of shin plate 138. As shown in FIG. 3, both upper edge 170 and lower edge 172 are angled, so that lateral side edge 174 is shorter than medial side edge 176. As medial side edge 176 is longer, shin plate 138 covers more of the medial side of the leg of catcher 10 than would a conventional leg guard, as shown in FIGS. 5 and 6.

Figure 4:
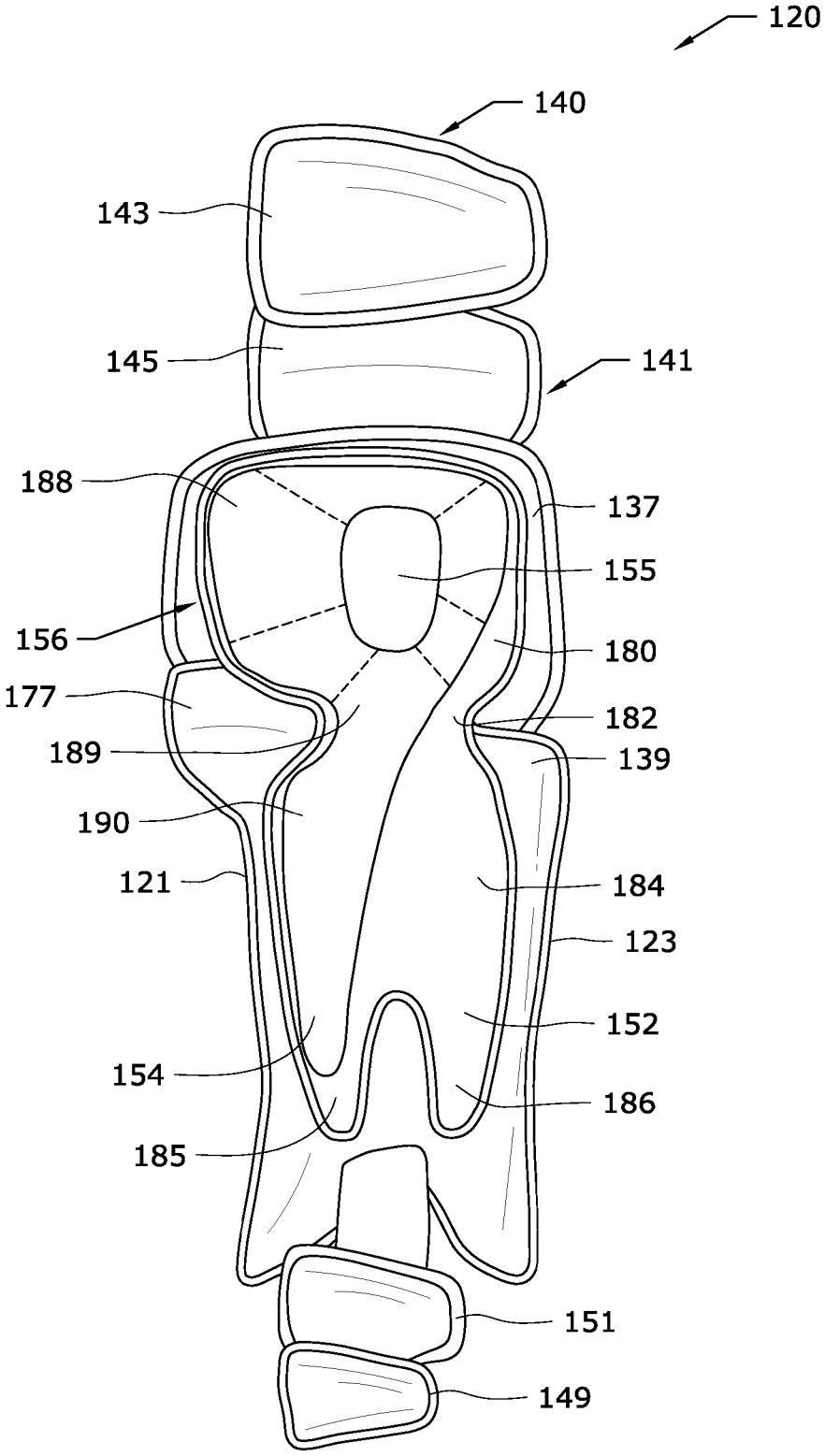
FIG. 4 is a schematic rear view of the leg guard of FIG. 3.

Similarly, shin pad 139 is also preferably asymmetric, with a medial side 121 of shin pad 139 extending to cover a significant portion of the medial side of the leg of catcher 10. In this embodiment, as best shown in FIG. 4, shin pad medial side extension 177 is a bulbous extension formed in an upper portion of shin pad 139. In other words, an upper portion of shin pad 139 extends further from center line C than does a lower portion of shin pad 139. This configuration minimizes the likelihood that shin pad 139 will interfere with the flexing of calf muscle as catcher 10 moves from the crouch position to a standing or blocking stance, while still maximizing the protection afforded the inner leg by shin pad 139.

Figure 8:
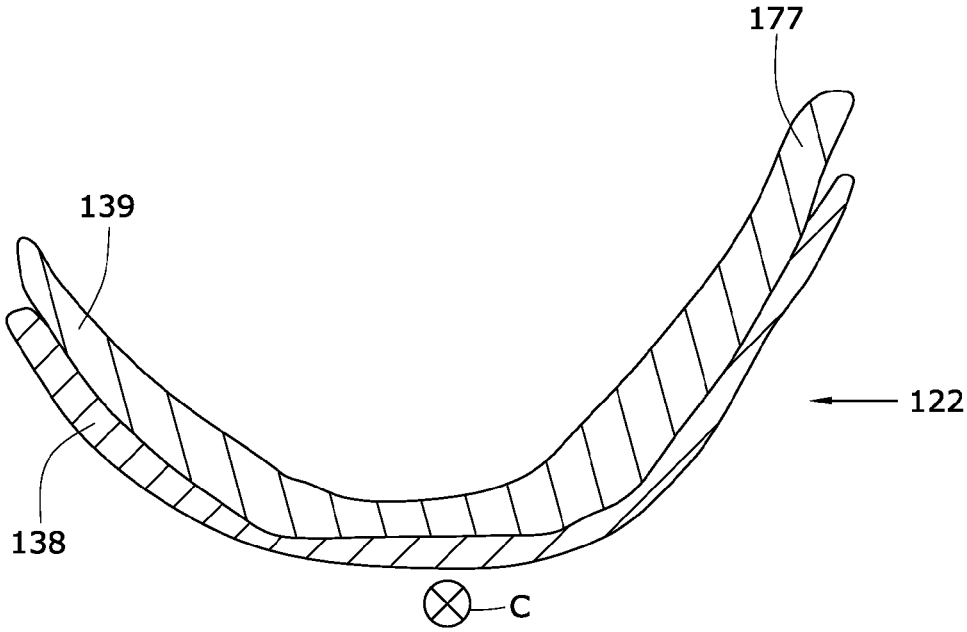
FIG. 8 is a cross-sectional view of a shin portion of the leg guard of FIG. 3, taken along line 8-8 in FIG. 3.

As best shown in FIG. 8, shin plate 138 and shin pad 139 are both contoured to follow the contour typical of the shin portion of the leg of catcher 10. Preferably, as can be seen by comparing FIGS. 7 and 8, the radius of curvature of shin portion 122 is less than that of knee portion 124, as the diameter of the shin of a leg is typically less than that of a bent knee. This contouring provides for a more comfortable fit. Additionally, shin plate 138 may include one or more protrusions 175, which are preferably formed integrally with shin plate 138 when shin plate 138 is molded. Protrusions 175 increase the flexibility and resiliency of shin plate 138 so that shin plate 138 is less likely to shatter when hit by a pitch or another player's cleats and also provides aesthetic interest.

First and second thigh portions 140, 142, foot portion 126, and ankle portion 128 are generally similar in construction to knee portion 124 and shin portion 122, with rigid plates preferably having a curved configuration backed by pads. While shown with irregular shapes, however, the asymmetry of first and second thigh portion 140, 142, foot portion 126, and ankle portion 128 is optional.

Preferably, each of the portions discussed above, first and second thigh portions 140, 142, knee portion 124, shin portion 122, foot portion 126, and ankle portion 128 are connected together by attaching the pad of one portion to the pad of an adjacent portion, as shown best in FIG. 4. The attachment may be done using any method known in the art, such as by stitching, with rivets, or using an adhesive. For example, first thigh portion 140 includes a first thigh pad 143, and second thigh portion 142 includes a second thigh pad 145. Second thigh pad 145 overlaps first thigh pad 143 so that first thigh pad 143 may be connected to second thigh pad 145. Alternatively, first thigh pad 143 may overlap second thigh pad 145. Similarly, second thigh pad 145 overlaps knee pad 137 so that knee pad 137, knee pad 137 overlaps shin pad 139, and ankle pad 151 overlaps foot pad 149 so that these pads may be attached together where the pads overlap.

Preferably, in order to accommodate the extreme angle of the ankle joint while catcher 10 is in the crouch position, shin pad 139 does not overlap adjacent ankle pad 151. Instead an ankle extension 146 connects shin portion 122 with ankle portion 128. Ankle extension 146 is preferably a separate piece of material, such as the material used for any of the pads described herein, or a similar material with a thinner foam layer, which is connected at one end to shin pad 139 and at the other end to ankle pad 151. Alternatively, ankle extension 146 may be formed integrally with shin pad 139, ankle pad 151, or combinations of both pads.

Further, to provide additional protection and support for the knee joint, preferably leg guard 120 includes additional padding for knee portion 124 and shin portion 122. As shown in FIG. 3, a first connector pad 152 is attached to knee pad 137 by any method known in the art, such as by stitching, and extends at least partially along the length of shin pad 139. Preferably, the shape of first connector pad 152 is approximately dentoid in shape, with a bulbous portion 180 positioned on knee pad 137, a thinned waist portion 182 positioned at the juncture of knee pad 137 and shin pad 139, and a lower portion 184 terminating in two legs 185, 186 on shin pad 139. This shape provides maximum protection, flexibility, and comfort during wear. Bulbous portion 180 covers substantially the entire knee of catcher 10, so padding protection of the knee is essentially doubled. Waist portion 182 is thinned so as to allow the knee to bend without needing to force first connector pad 152 to bend as well. Lower portion 184 provides substantial coverage of the shin, while legs 185, 186 allow first connector pad 152 to wrap more easily around the lower leg.

Additionally, yet another optional layer of padding protection may be added with medial pad 154. Medial pad 154 is made of the same or similar material as any of the pads discussed above, and is attached to connector pad 152 by any method known in the art, such as by stitching. Preferably, the shape of medial pad 154 generally follows the contours of connector pad 152, with a bulbous upper portion 188 and a thinned waist portion 189. However, a lower portion 190 includes only one leg 154 following the outline of connector pad 152 on a medial side 121. Additionally, to better accommodate the knee and to maintain the full range of motion of the knee, a knee hole 155 is provided in bulbous portion 188. Preferably, knee hole 155 surrounds and supports the knee cap portion of the knee, which provides additional stability to the joint when moving from the crouch stance to a blocking stance or defensive upright position and vice versa. Over time, this reduced stress on the knee joint may help to extend the playing life of a catcher.

Figure 9:
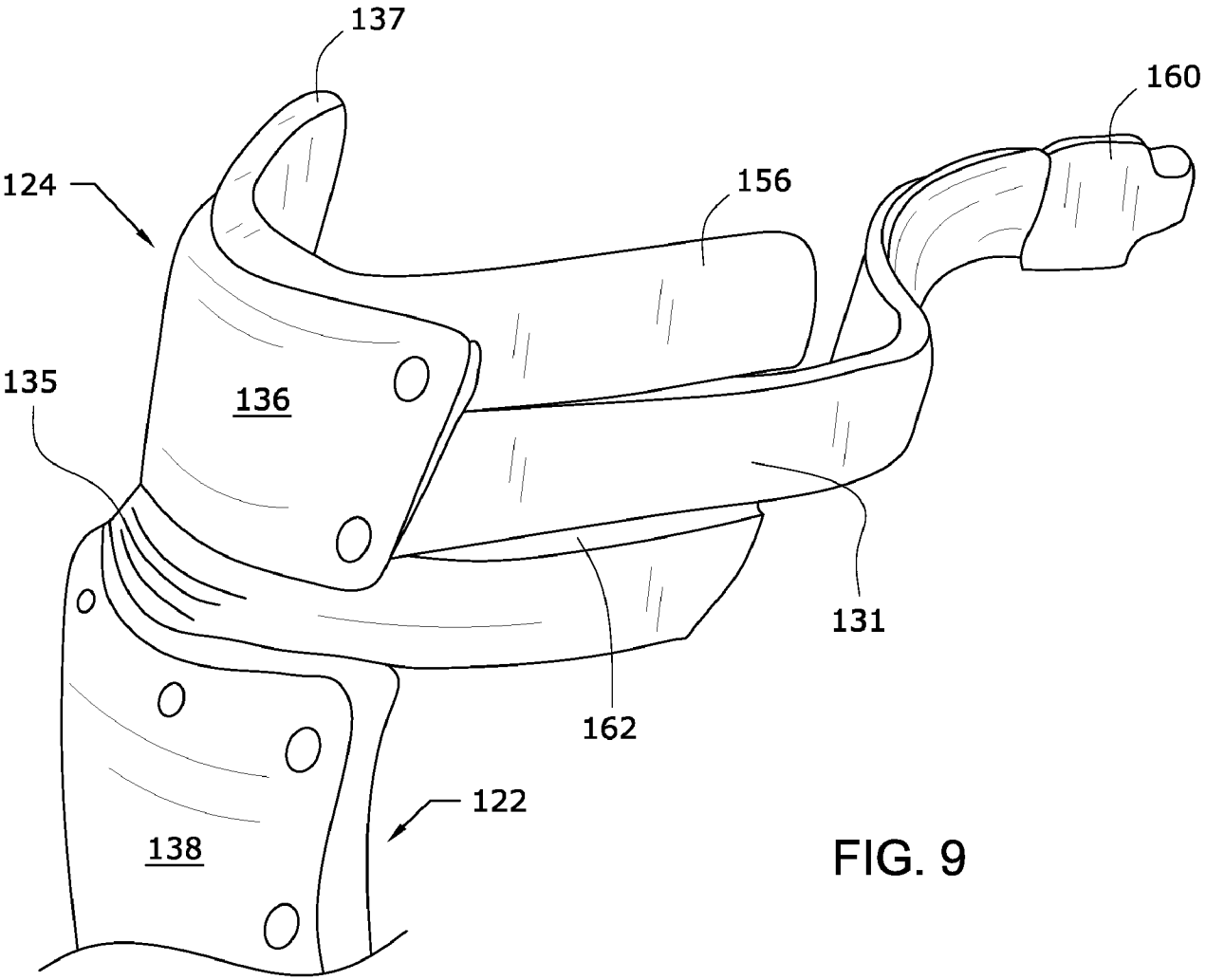
FIG. 9 is a partial schematic perspective view of a leg guard according to the invention.

Leg guard 120 is preferably removably and adjustably attachable to the leg of catcher 10. As shown in FIGS. 2, 6, and 9, a strapping system 130 is preferably provided to secure leg guard 120 in position on and around the legs. Strapping system 130 preferably includes a thigh strap 134, a knee strap 131, an upper shin strap 132 and a lower shin strap 133. In other embodiments, one or more of these straps may be eliminated, while in yet other embodiments, more straps may be included. Straps 134, 131, 132, 133 are preferably made of a durable, substantially inelastic material, such as a woven natural or synthetic material, such as woven nylon, and may include an adjustable portion, such as an extra length of material which may be pulled through a clip and secured in position to lengthen or shorten the strap. Preferably, straps 134, 131, 132, 133 are fixedly attached to one side of leg guard 120, such as by sewing or riveting straps 134, 131, 132, 133 to the corresponding pads, for example, sewing knee strap 131 to a lateral side 123 or a medial side 121 of knee pad 137. On the other side of leg guard 120, straps 134, 131, 132, 133 are detachably attachable to leg guard 120. For example, as shown in FIG. 9, a securing mechanism 160, such as a hook, clip, or similar device is provided on strap 131. Securing mechanism 160 removably attaches to a corresponding slot, clip, hook, or similar device fixedly attached to leg guard 120 (not shown). To wear leg guard 120, catcher 10 positions leg guard 120 on the leg, pulls strap 131 around the back of the knee, then attaches securing mechanism 160 to leg guard 120. To remove leg guard 120, catcher 10 disconnects securing mechanism 160 from leg guard 120, and removes leg guard from the leg. Similar motions may be performed to attach or detach all straps on leg guard 120.

In a preferred embodiment, straps 134, 131, 132, 133 are further held in position so that straps 134, 131, 132, 133 do not chafe the leg of catcher 10 during play. Straps 134, 131, 132, 133 may be held relatively stationary in a number of ways, including passing straps 134 through additional hoops formed on or attached to leg guard 120. In a preferred embodiment, as shown in FIG. 9, strap 131 is held within a groove 162 which is sized and dimensioned to retain strap 131 while leg guard 120 is worn by catcher 10. Groove 162 is preferably formed in knee pad 137 by any method known in the art, such as compression molding or cutting. Other pads, such as first thigh pad 143 and shin pad 139, may also include similar grooves for retaining thigh strap 134 or shin straps 132, 133.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

What is claimed is:

1. A leg guard defining a vertical center line which is substantially perpendicular to a substantially flat ground surface and which passes through a geometric center point of a knee comprising:

a knee portion having a first rigid layer and a first flexible layer connected to the first rigid layer;

a shin portion having a second rigid layer and a second flexible layer connected to the second rigid layer;

the first flexible layer being connected to the second flexible layer;

the first rigid layer having an irregular shape, with a first rigid layer medial side extending further from the center line of the leg guard than a first rigid layer lateral side;

the second rigid layer having an irregular shape, with a second rigid layer medial side extending further from the center line than a second rigid layer lateral side;

a securing system configured to removably attach the leg guard to a leg;

a third flexible layer attached to the first flexible layer and the second flexible layer, the third flexible layer having a bulbous knee section and an elongated shin section;

the elongated shin section having at least one tail section; and a fourth flexible layer attached to the third flexible layer, wherein an inner perimeter of a knee portion of the fourth flexible layer is configured to at least partially surround a knee cap portion of a knee.

2. The leg guard according to claim 1, the first flexible layer having an irregular shape, with a first flexible layer medial side extending further from the center line than a first flexible layer lateral side.

3. The leg guard according to claim 2, the first flexible layer medial side dimensioned to substantially cover a medial knee portion.

4. The leg guard according to claim 1, wherein the third flexible layer has a dentoid shape.

5. The leg guard according to claim 1, wherein at least one of the flexible layers includes flex ridges.

6. The leg guard according to claim 5, wherein the flex ridges are disposed between the first rigid layer and the second rigid layer, wherein the flex ridges extend substantially horizontally across the leg guard.

7. The leg guard according to claim 1, wherein at least one rigid layer comprises a plastic material.

8. The leg guard according to claim 1, wherein the fourth flexible layer comprises a knee hole, the knee hole configured to be positioned over and accommodate a knee cap of the knee when the protective covering is worn, wherein the knee hole is defined by the inner perimeter of the fourth flexible layer.

9. The leg guard according to claim 1, further comprising at least one thigh portion comprising a thigh rigid layer and a thigh flexible layer, the thigh flexible layer being connected to the first flexible layer.

10. The leg guard according to claim 1, further comprising at least one foot portion comprising a foot rigid layer and a foot flexible layer attached to the foot rigid layer, the foot flexible layer being connected to the second flexible layer.

11. The leg guard according to claim 1, the securing system comprising at least one strap having a fixed end and a free end, the fixed end being fixedly attached to a first side of the leg guard and the free end configured to be removably attached to a second side of the leg guard.

12. The leg guard according to claim 11, a securing mechanism attached to the free end of the strap and a receiving mechanism configured to detachably receive the securing mechanism fixedly attached to the second side of the leg guard.

13. The leg guard according to claim 11, a guide formed in the leg guard to receive the strap to prevent the strap from shifting during wear.

14. The leg guard according to claim 1, the first rigid layer having a first radius of curvature and the second rigid layer having a second radius of curvature.

15. The leg guard according to claim 14, wherein the first radius of curvature is different from the second radius of curvature.

16. A protective covering for a shin defining a vertical center line which is substantially perpendicular to a substantially flat ground surface and which passes through a geometric center point of a knee comprising:

a rigid layer configured to cover an obverse side of the shin;

the rigid layer having an irregular shape;

a medial side of the rigid layer being longer than a lateral side of the rigid layer;

a medial portion of the rigid layer extending further from the center line of the protective covering than a lateral portion of the rigid layer;

a flexible layer positioned between the rigid layer and the shin; and a strapping system configured to removably attach the rigid layer and the flexible layer to a leg.

17. The protective covering according to claim 16, the flexible layer covering a greater area than the rigid layer.

18. The protective covering according to claim 16, the flexible layer having a split portion.

19. The protective covering according to claim 16, the flexible layer attached to at least one additional flexible layer.

20. The protective covering according to claim 19, the at least one additional flexible layer attached to a second protective covering.

21. The protective covering according to claim 19, the at least one additional flexible layer having a dentoid shape.

* * * * *